United States Patent [19]

Bagchi et al.

[11] Patent Number: 4,990,431

[45] Date of Patent: Feb. 5, 1991

[54] METHODS OF FORMING STABLE DISPERSIONS OF PHOTOGRAPHIC MATERIALS

[75] Inventors: Pranab Bagchi, Webster; James T. Beck; Lia A. Crede, both of Rochester, all of N.Y.

[73] Assignee: Eastman Kodak Company, Rochester, N.Y.

[21] Appl. No.: 297,005

[22] Filed: Jan. 17, 1989

[51] Int. Cl.[5] ..... G03C 7/26; G03C 7/32

[52] U.S. Cl. ..... 430/372; 430/546; 430/377; 430/449; 430/631; 430/637

[58] Field of Search ..... 430/372, 546, 377, 449, 430/631, 637

[56] References Cited

U.S. PATENT DOCUMENTS

| | | | |
|---|---|---|---|
| 2,322,027 | 6/1943 | Jelley et al. | 430/546 |
| 2,870,012 | 1/1959 | Godowsky et al. | 430/546 |
| 3,335,011 | 8/1967 | White | 430/546 |
| 3,658,546 | 4/1972 | Van Doorselaer et al. | 430/546 |
| 3,860,425 | 1/1975 | Ono et al. | 430/546 |
| 3,936,303 | 2/1976 | Shiba et al. | 430/546 |
| 4,291,113 | 9/1981 | Minamizono et al. | 430/202 |
| 4,385,110 | 5/1983 | Yoneyama et al. | 430/372 |

FOREIGN PATENT DOCUMENTS

| | | | |
|---|---|---|---|
| 578768 | 6/1959 | Canada | 430/546 |
| 1148178 | 4/1969 | United Kingdom . | |
| 1164095 | 9/1969 | United Kingdom . | |
| 1193349 | 5/1970 | United Kingdom . | |
| 2140572 | 11/1984 | United Kingdom . | |

OTHER PUBLICATIONS

William J. Priest, Research Disclosure 16468, Process for Preparing Stable Aqueous Dispersions of Certain Hydrophobic Materials, (1977), pp. 75-80, 1977 Industrial Opportunities Ltd.

*Primary Examiner*—Paul R. Michl
*Assistant Examiner*—Patrick Doody
*Attorney, Agent, or Firm*—Paul A. Leipold

[57] ABSTRACT

The invention is performed by providing a first flow of water and surfactant, a second flow comprising solvent, base and photographic material, and mixing said first and second streams and either simultaneously or immediately following thereof neutralizing said streams to prevent hydrolysis of a hydrolyzable surfactant and/or premature precipitation of particles before neutralization. The streams then may be immediately treated for formation into photographic materials. In a preferred method the first and second stream may be brought together immediately prior to a mixer with addition of acid directly into the mixer to neutralize the dispersion of fine particles.

29 Claims, 4 Drawing Sheets

METHODS OF FORMING STABLE DISPERSIONS OF PHOTOGRAPHIC MATERIALS

FIELD OF THE INVENTION

This invention relates to the formation of dispersions of photographic materials by precipitation from solution. It particularly relates to the formation of dispersions in a continuous or semicontinuous manner.

PRIOR ART

It has been known in the photographic arts to precipitate photographic materials, such as couplers, from solvent solution. The precipitation of such materials can generally be accomplished by a shift in solvent and/or a shift in pH. The precipitation by a shift in solvent is normally accomplished by the addition of an excess of water to a solvent solution. The excess of water in which the photographic component is insoluble will cause precipitation of the photographic component as small particles. In precipitation by pH shift, a photographic component is dissolved in a solvent that is either acidic or basic. The pH is then shifted such that acidic solutions are made basic or basic solutions are made acidic in order to precipitate particles of the photographic component which is insoluble at that pH.

In United Kingdom Patent No. 1,193,349-Townsley et al discloses a process when an organic solvent, aqueous alkali solution of a color coupler is mixed with an aqueous acid medium to precipitate the color coupler. It is set forth that the materials can either be utilized immediately, or a dispersion of the particles and gelatin can be gelled and remelted.

In an article in *Research Disclosure*, December, 1977, entitled "Process for Preparing Stable Aqueous Dispersions of Certain Hydrophobic Materials", pages 75–80, by William J. Priest, it is disclosed that color couplers can be formed by precipitation of small particles from solutions of the couplers in organic solvents.

Such precipitated dispersion particle formation processes have been successful in forming laboratory quantities of photographic materials. It is not believed that such dispersion particle formation of photographic materials has been successfully scaled up for commercial utilization. One difficulty with scaling up for commercial utilization is that the large quantities required do not successfully lend themselves to the batch techniques utilized in laboratory formation. A continuous technique would be desirable. Certain surfactants are potent in the formulation of such dispersions, but contain chemical linkages that are hydrolyzed by base in the micellar solution. This causes problems with scaling up, in both batch and continuous processes where considerable loss of the surfactant by hydrolysis is encountered. This problem is particularly severe in production, wherein because of the large volumes involved, the time of wait before neutralization of the micellar solution is very long (greater than ½ to 2 hours). The micellar solution is the basic coupler solution mixed with the aqueous surfactant solution, at highly alkaline pH, prior to neutralizing with acid. When the surfactant hydrolyzes, the particles from lack of enough stabilizer form larger particles that are, in many cases, less reactive and therefore undesirable. Time required in equipment preparation in pilot scale or full scale manufacturing may make it necessary for such solutions to sit for periods of time up to several hours. It is necessary to adjust the pH of the basic coupler containing solution to slightly acid (about 6 pH) to effect the formation of the dispersion. The addition of the neutralizing acid to large volumes of material cannot be performed rapidly enough to prevent formation of large particulate dispersions. If the micellar solution remains at high pH for a long enough time, such hydrolyzable surfactants undergo extensive hydrolysis and causes the formation of large particles, due to lack of stabilizing surfactant, prior to neutralization with acid. Therefore, the particle sizes will not be uniform from batch to batch, as they will vary depending on how long the micellar solution was formed prior to utilization or neutralization. It will be necessary to discard large quantities of coupler dispersion that will not meet manufacturing specifications. Therefore, there is a need for a continuous method of forming dispersed particles that can avoid hydrolysis of the stabilizing surfactant and as well may be rapidly started and stopped with minimum waste.

THE INVENTION

Generally the invention is performed by providing a first flow of water and surfactant, a second flow comprising solvent, base, and photographic material, bringing together said first and second streams and then either simultaneously or immediately following mixing, neutralizing said streams to precipitate particles. The instantaneous control of pH to form a neutral solution with particle precipitation leads to a stable dispersion of uniform small particles. The stream containing dispersed particles then may be immediately processed for forming said particles into photographic materials or they may be washed by ultrafiltration and then stored, for use in a photographic element at a later time.

In preferred methods the first and second stream may be brought together immediately prior to a centrifugal mixer with addition of acid directly into the mixer. In the alternative, the first and second flow, as well as the acid flow, may all be added simultaneously in the centrifugal mixer. The streams will have a residence time about 1 to about 30 seconds in the mixer. When leaving the mixer, they may immediately be processed for utilization in photographic materials. When the process is stopped, the mixer may be shut off with minimum waste of material as it is only necessary to discard the material in the mixer and pipe lines immediately adjacent to it when the process is reactivated after a lengthy shutdown.

The invention can be performed in semicontinuous batch mode by introducing the surfactant and water into the reaction chamber fitted with a mixing device, such as a stirrer, and a pH probe (with associated temperature sensing thermistor probe), bringing in a first flow of the basic coupler solution-containing solvent into the reaction chamber at a fixed flow rate, then bringing in the second flow of the neutralizing aqueous acid using a variable speed pump proportionally controlled by a pH controller. The pH probe secures the pH of the reactor, the pH information is compared to the set precipitation pH value, usually 6.0, by the controller which then sends a signal proportional to the difference between the set pH value and the sensed pH value to the neutralizing acid pump that then pumps acid into the reaction chamber until pH of the reaction chamber drops below the set pH value. In this manner of small cycles the coupler particle precipitation takes place in the reaction chamber with a fluctuation pH of ±0.2 pH units around the set pH. In such a process, the pH of the reaction chamber never fluctuates between to either highly alkaline or acidic pH to cause any hydrolysis of the surfactant. For a continuous process the invention is accomplished by bringing a surfactant flow into the reaction chamber at constant rate in proportion with the flow rate of the basic coupler solution, and providing outflow at a constant head in the reaction chamber allows the withdrawal of the formed dispersion. Allowing a constant outflow head provides a constant volume of material in the reaction vessel. Since pH sensing times and time required to adjust flow rates of the acid are usually slow, this process is not used for pilot scale or production scale, but used in pre pilot and research scale formation of such dispersions. However, this procedure produces dispersions with very similar physical and photographic properties as those described in the previous two paragraphs.

MODES OF PERFORMING THE INVENTION

The invention provides numerous advantages over prior processes of forming dispersions of photographic components. The invention provides continuous or semicontinuous methods in which the particle size of the formed dispersions will be uniform from run to run. Shutdowns of the system can be accomplished with minimum waste or growth of particle size. Further, cost is low as there are no storage tanks for storing micellar solution necessary in the process. Another advantage of the invention is that there is less surfactant used in the invention as it is not given time to hydrolyze prior to being immediately neutralized with acid and, therefore, use of excess is not necessary. These and other advantages of the invention will become apparent from the detailed description below.

Figure 1:
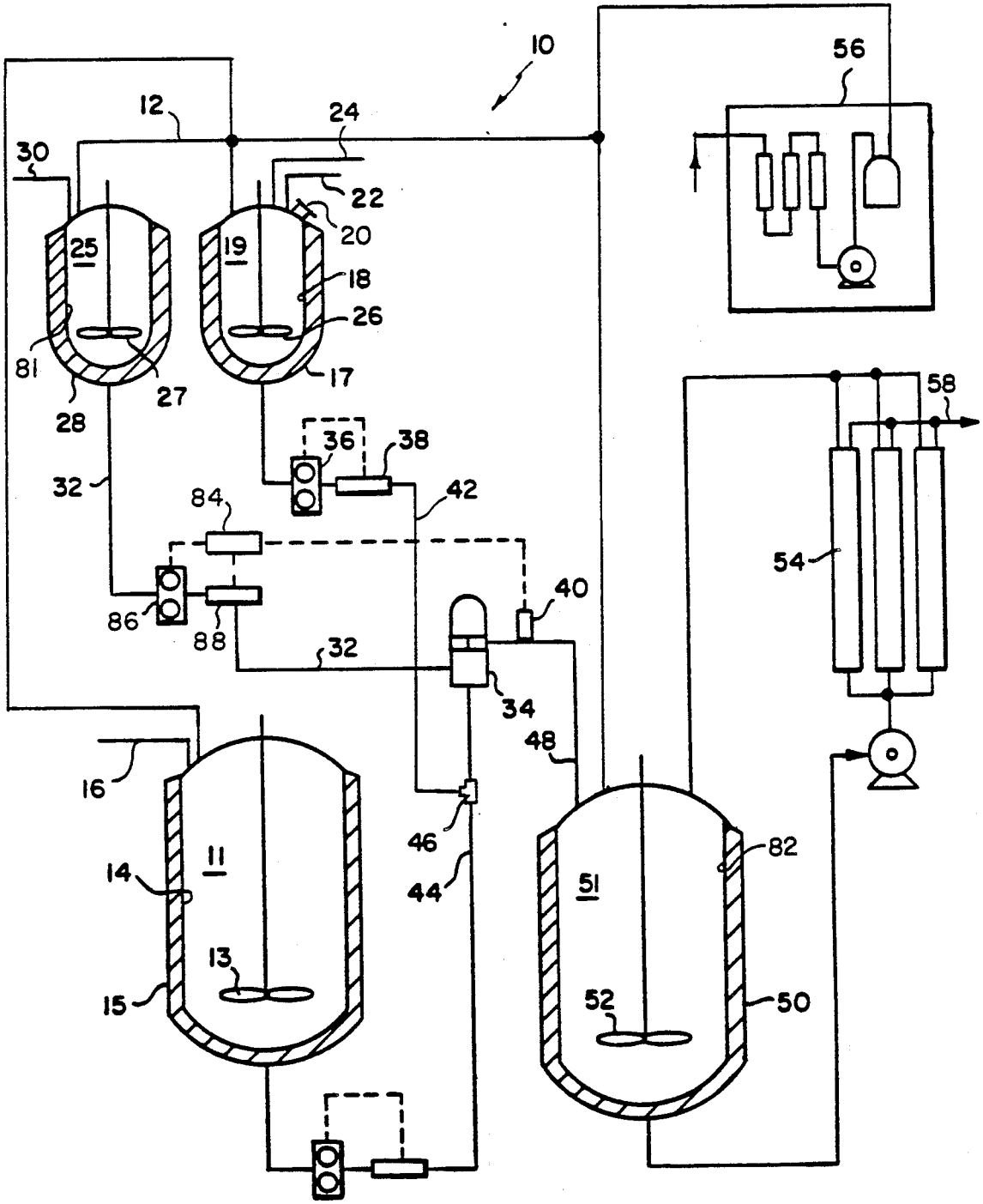
FIG. 1 illustrates schematically a formation system of the invention with blending of the solvent and coupler solution and the aqueous surfactant solution immediately prior to neutralization by the acid solution in the reaction chamber, with the mixer.

The schematic of FIG. 1 illustrates apparatus 10 for performing the process of the invention. The apparatus is provided with high purity water delivery lines 12. Tank 14 contains a solution 11 of surfactant and high purity water. Jacket 15 on tank 14 regulates the temperature of the tank. Surfactant enters the tank through line 16. Tank 18 contains a photographic component solution 19. Jacket 17 controls the temperature of materials in tank 18. The tank 18 contains a coupler entering through manhole 20, a base material such as aqueous sodium hydroxide solution entering through line 22, and solvent such as n-propanol entering through line 24. The solution is maintained under agitation by the mixer 26. Tank 81 contains acid solution 25 such as propionic acid entering through line 30. The tank 81 is provided with a heat jacket 28 to control the temperature, although with the acids normally used, it is not necessary. In operation, the acid is fed from tank 81 through line 32 to mixer 34 via the metering pump 86 and flow meter 88. A pH sensor 40 senses the acidity of the dispersion as it leaves mixer 34 and allows the operator to adjust the acid pump 86 to maintain the proper pH in the dispersion exiting the mixer 34. The photographic component 19 passes through line 42, metering pump 36, flow meter 38, and joins the surfactant solution in line 44 at the T fitting 46. The particles are formed in mixer 34 and exit through pipe 48 into the ultrafiltration tank 82. In tank 82 the dispersion 51 is held while it is washed by ultrafiltration membrane 54 to remove the solvent and salt from solution and adjust the material to the proper water content for makeup as a photographic component. The source of high purity water is purifier 56. Agitator 13 agitates the surfactant solution in tank 14. Agitator 27 agitates the acid solution in tank 81. The impurities are removed during the ultrafiltration process through permeate (filtrate) stream 58.

Figure 2:
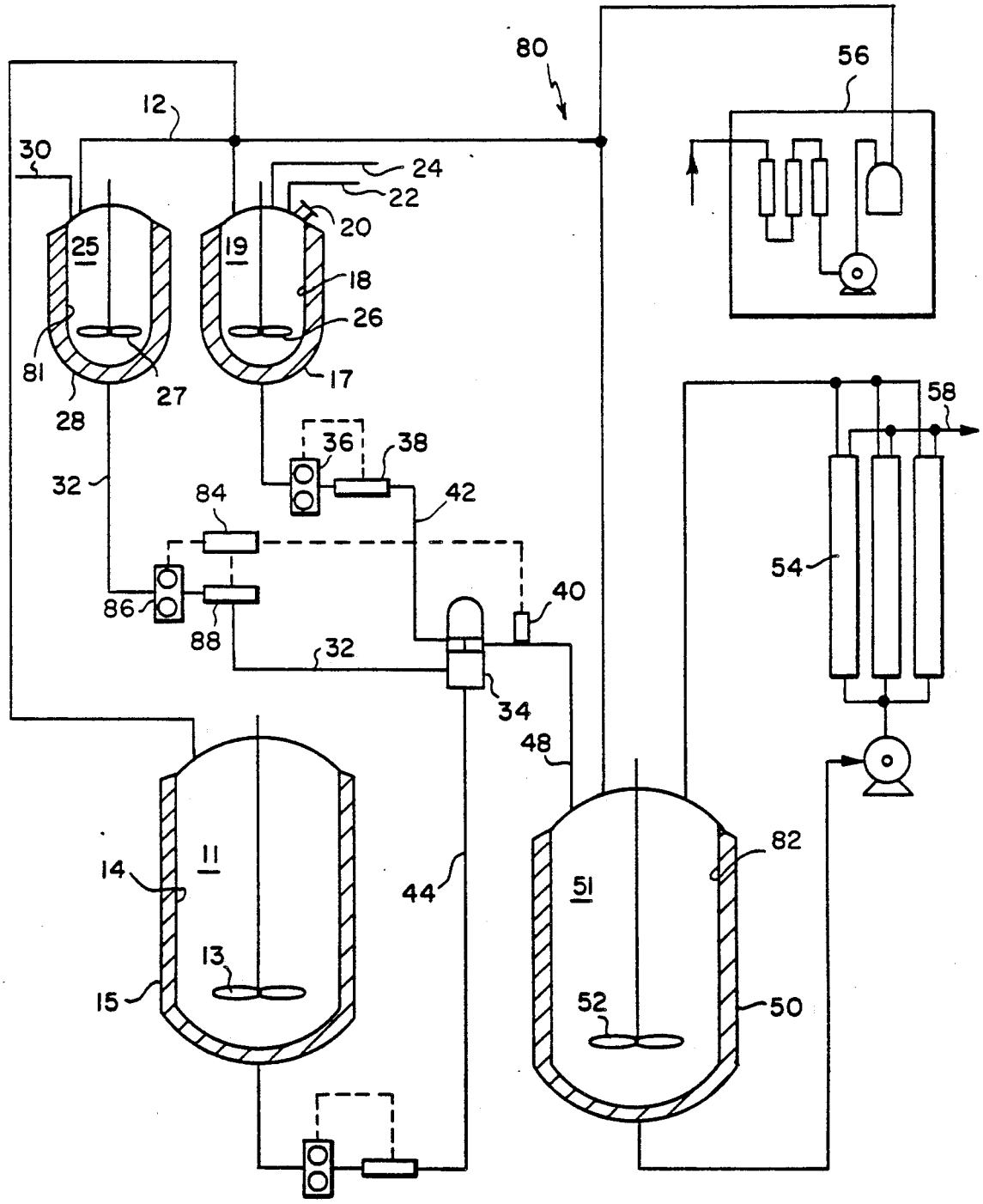
FIG. 2 schematically illustrates the system of the invention with streams of acid solution, coupler solution, and surfactant solution being supplied directly to the reaction chamber with the mixer.

The apparatus 80 schematically illustrated in FIG. 2 is similar to that illustrated in FIG. 1 except that the acid solution in pipe 32, the surfactant solution in pipe 44, and the photographic component solution in pipe 42 are directly led to mixing device 34. Corresponding items in FIG. 1 and FIG. 2 have the same numbers. In this system all mixing takes place in the mixer 34 rather than joining of the surfactant solution and the photographic component in the T connection immediately prior to the mixer as in the FIG. 1 process.

Figure 3:
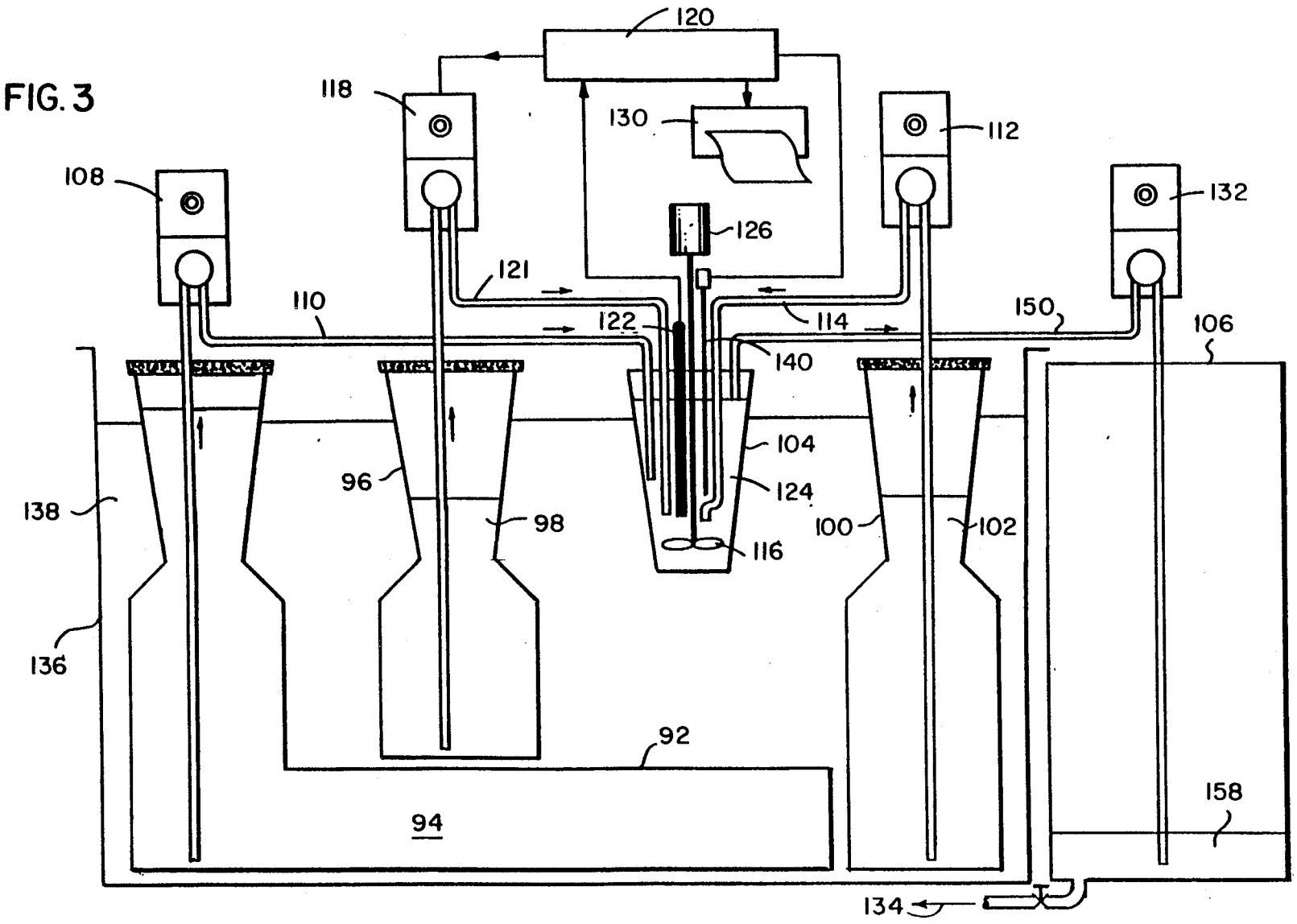
FIG. 3 illustrates a semicontinuous automatic pH-controlled precipitation device.
Figure 4:
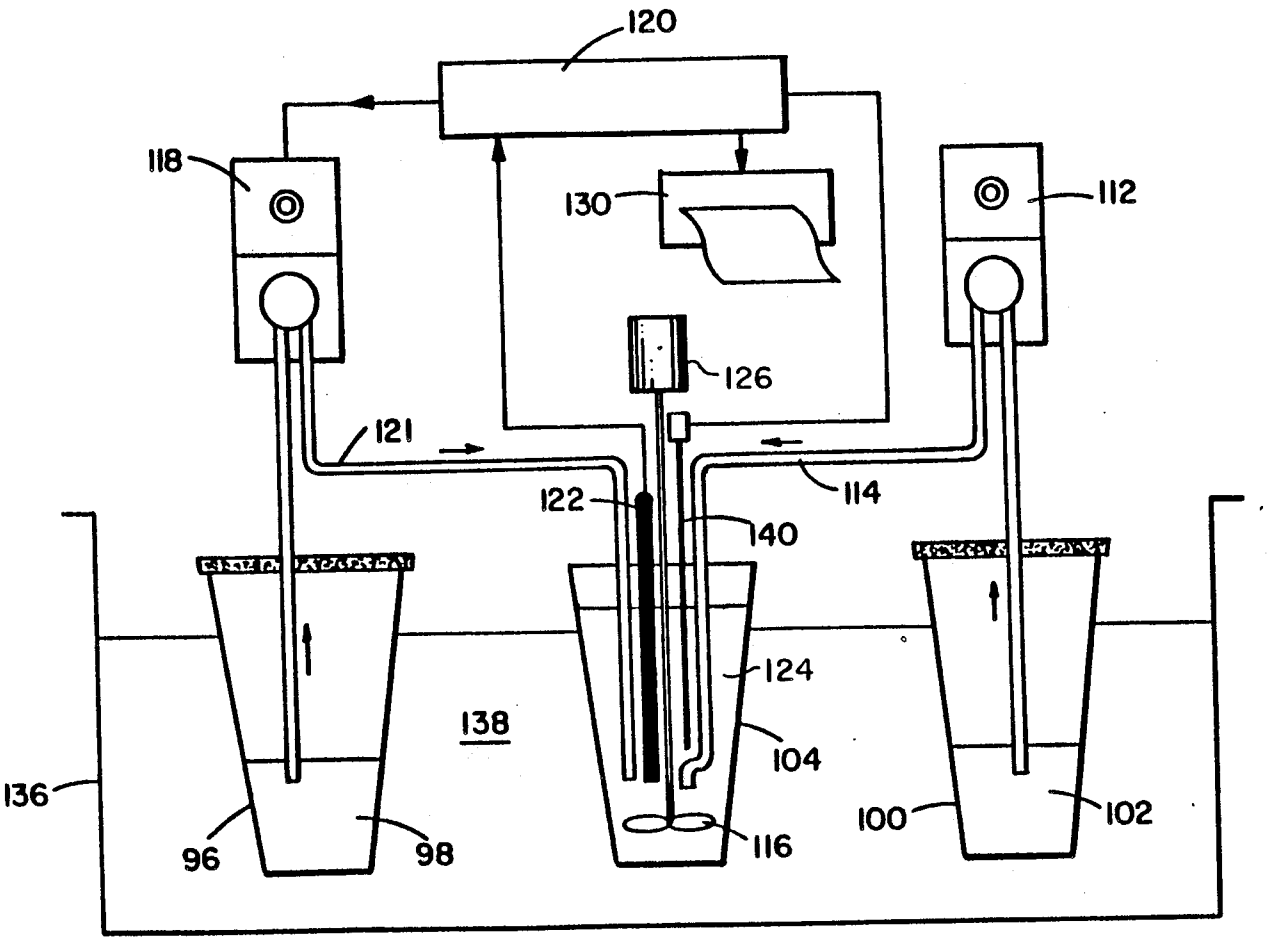
FIG. 4 illustrates a continuous automatic pH-controlled precipitation device.

The invention finds its most preferred use in large scale production such as in a continuous commercial process. However, preparation of dispersions in pH-controlled conditions can also be practiced on a smaller and/or slower scale in a semicontinuous or continuous manner. The devices of FIGS. 3 and 4 illustrate equipment that is in accordance with the invention for smaller scale production. It is noted that to scale up such equipment to commercial production is difficult, as pH control would not be rapid enough at very high flow rates that are necessary for production scale for economic viability. The practice of the invention requires neutralization to be complete within not more than about two minutes from the time the solvent and water solutions join. For most uniform particles it is preferred that neutralization be complete within less than about one minute. The device of FIG. 3 was designed for continuous and semicontinuous pH-controlled precipitation of dispersions. The apparatus 90 of FIG. 3 provides a continuous means for precipitation of coupler dispersions. Container 92 is provided with an aqueous surfactant solution 94. Container 96 is provided with an acid solution. Container 100 contains a basic solution 102 of coupler in solvent. Container 104 provides a mixing and reacting chamber where the dispersion formation takes place. Container 106 is a collector for the dispersed coupler suspensions 158. In operation the surfactant solution 94 is metered by pump 108 through line 110 into the reactor vessel 104. At the same time the basic coupler solution is metered by pump 112 through line 114 into the reactor 104 at a constant predetermined rate. The solutions are agitated by stirrer 116, and acid 98 is metered by pump 118 through line 121 into the reactor 104 to neutralize the solution. The pumping by metering pump 118 is regulated by controller 120. Controller 120 is provided with a pH sensor 122 that senses the pH of the dispersion 124 in reactor 104 and controls the amount and the rate of the addition of acid 98 added by pump 118 to neutralize the content of the reaction chamber. The drive for stirrer 116 is 126. The recorder 130 constantly records the pH of the solution to provide a history of the dispersion 124. Metering pump 132 withdraws the dispersion solution from reactor 104 and delivers it to the container 106 using pump 132 and line 150 where it may exit from the outlet 134. In a typical precipitation there is a basic coupler solution 102 of solvent, sodium hydroxide solution, and the coupler. The surfactant is in water, and the neutralizing acid is an aqueous solution of acetic or propionic acid. The reaction chamber has a capacity of about 800 ml. The coupler solution tank 100, has a capacity of about 2500 ml. The surfactant solution tank 92, has a capacity of about 5000 ml. The acid solution tank has a capacity of about 2500 ml and the dispersion collection tank has a capacity of about 10,000 ml. The temperature is controlled by placing the four containers 92, 96, 104, and 100 in a bath 136 of water 138 whose temperature can be regulated to its temperature up to 100° C. Usually precipitation is carried out at 25° C. The temperature of the bath 138 is controlled by a steam and cold water mixer (not shown). The temperature probe 140 is to sense the temperature of the reactor. This is necessary for correct pH reading. The neutralization of the basic coupler solution in the reaction chamber 104 by the proportionally controlled pump 118 which pumps in acid solution 98 results in control of pH throughout the run to ±0.2 of the set pH value which is usually about 6.0. In the continuous mode similar volumes as pilot scale equipment can be and has been made, except that the flow rates being about 20–30 times smaller than the pilot scale equipment of FIGS. 1 and 2, the preparation takes about 20–30 times longer.

FIG. 4 schematically illustrates a semicontinuous system for forming dispersions of coupler materials. Identical items are labeled the same as in FIG. 3. Because of reduced scale, the sizes of acid kettle 96 and the coupler kettle 100 are smaller (about 800 ml each). In the system of FIG. 4, the reactor 104 is initially provided with an aqueous surfactant solution. In this is pumped a basic solution of coupler and solvent 102 through pipe 114. 122 is a pH sensor that working through controller 120 activates pump 118 to neutralize the dispersion to a pH of about 6 by pumping acetic acid 98 through metering pump 118 and line 121 to the reactor 104. Reactor 104 must be removed, dumped, and refilled with the aqueous surfactant solution in order to start a subsequent run. However, the systems of FIGS. 3 and 4 do provide fast control of pH in order to produce economically viable production runs. All dispersion formulations may be formulated and optimized using the semicontinuous process using this equipment before scale up for continuous running in continuous production equipment such as that of FIGS. 1 and 2.

The surfactants of the invention may be any surfactant that will aid in formation of stable dispersions of particles. Typical of such surfactants are those that have a hydrophobic portion to anchor the surfactant to the particle and a hydrophilic part that acts to keep the particles separated. Typical of such a surfactant is sodium lauryl sulfate and surfactants containing a $C_8$ to $C_{25}$ carbon chain and a hydrophilic head comprising of 3–30 oxyethylene groups in a chain. Such a surfactant may be terminated by one or more charge groups, such as $—So_3^-$ or $—CO_3^-$ groups at the hydrophilic end. Preferred surfactants have been found to be Aerosol A102 from Cyanamid, Aerosol A103 from Cyanamid, and Polystep B23 from Stepan Chemical, as they give stable dispersion at near neutral pH. The formulas are given below:

Aerosol A102

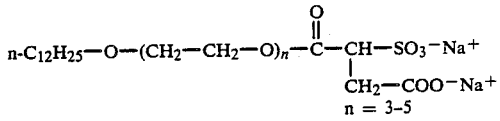

Aerosol A103

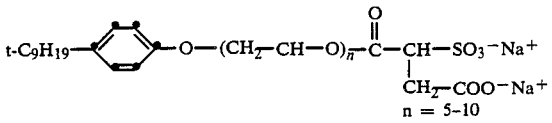

Polystep B23

Both Aerosol A102 and A103 are base hydrolyzable, whereas polystep B23 is not. The described process is suitable for surfactants that are prone to hydrolysis or are base degradable.

The invention may be practiced with any hydrophobic photographic component that can be solubilized by base and solvent. Typical of such materials are colored dye-forming couplers, development inhibitor release couplers, development inhibitors, filter dyes, UV-absorbing dyes, development boosters, development moderators, and dyes. Suitable for the process of the invention are the following compounds, dispersions of which were prepared by a method of this invention:

(1)
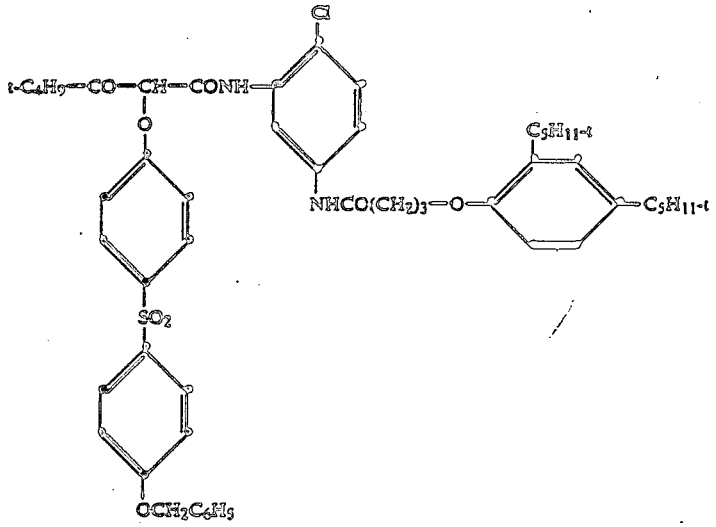
(2)
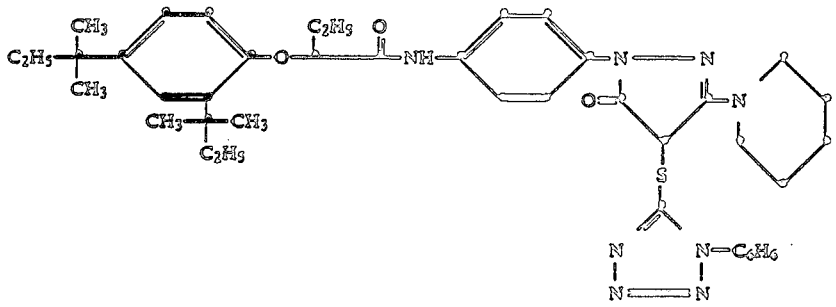
(3)
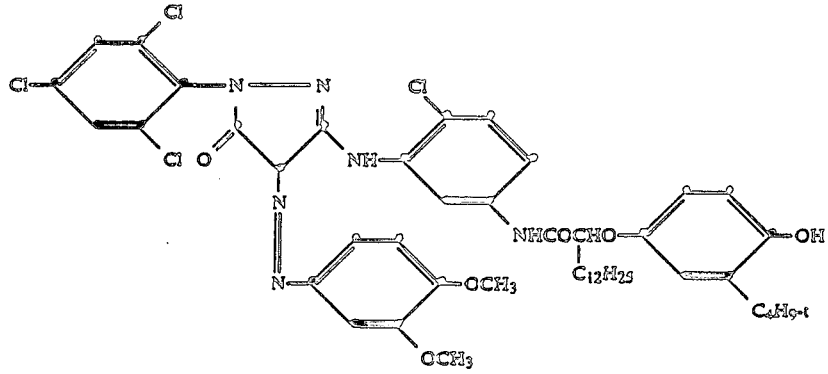
(4)
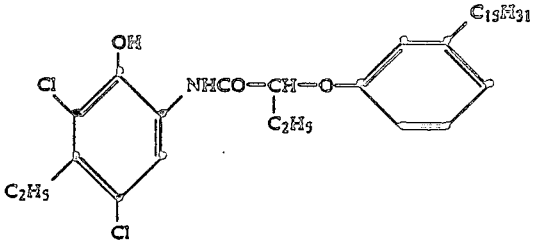

-continued
(5)
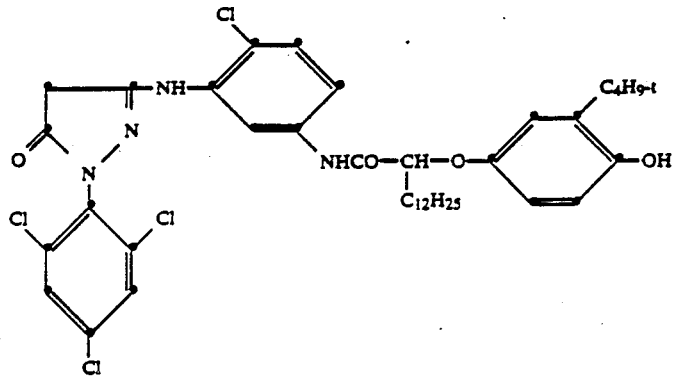
(6)
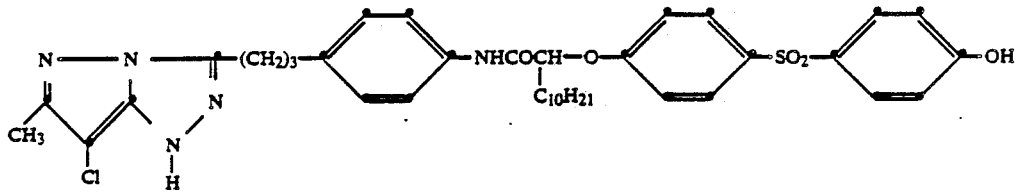
(7)
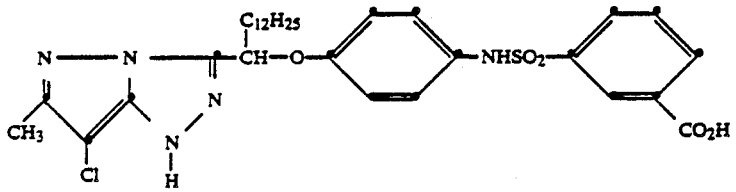
(8)
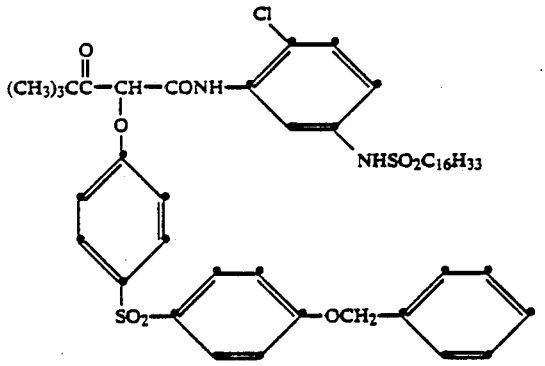
(9)
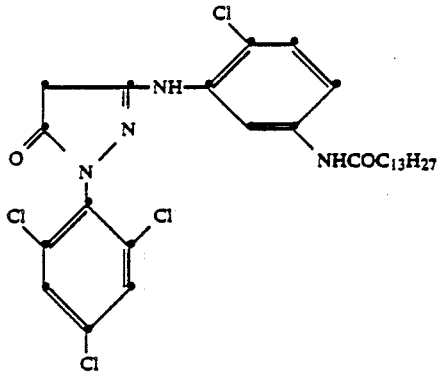
(10)
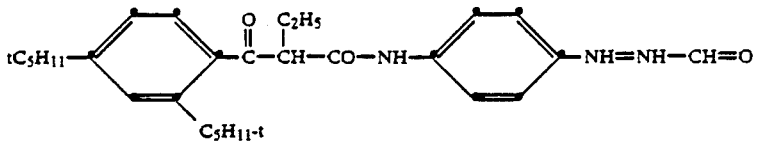

-continued (11)

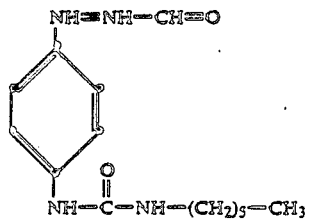

(12)

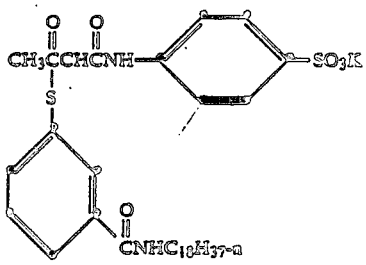

(13)

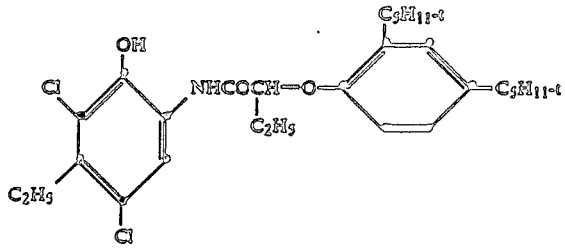

(14)

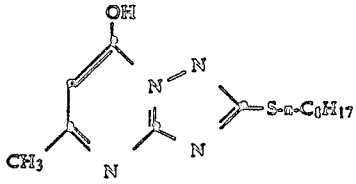

(15)

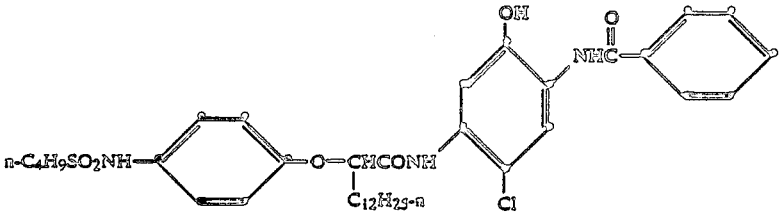

(16)

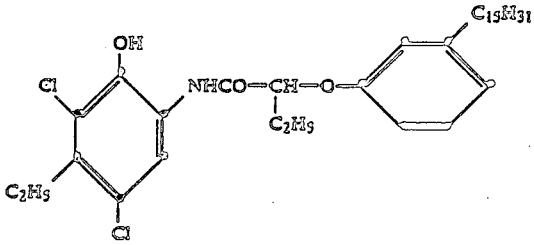

and many other color couplers and compounds.

Preferred material for utilization in the process are couplers 1, 2, 3, and 9, as these provide the most stable dispersions and best photographic results.

The mixing chamber, where neutralization takes place, may be of suitable size that has a short residence time and provides high fluid shear without excessive mechanical shear that would cause excessive heating of the particles. In a high fluid shear mixer, the mixing takes place in the turbulence created by the velocity of fluid streams impinging on each other. Typical of mixers suitable for the invention are centrifugal mixers, such as the "Turbon" centrifugal mixer available from Scott Turbon, Inc. of Van Nuys, Calif. It is preferred that the centrifugal mixer be such that in the flow rate for a given process the residence time in the mixer will be of the order of 1–30 seconds. Preferred residence time is 10 seconds to prevent particle growth and size variation. Mixing residence time should be greater than 1 second for adequate mixing.

The solvent for dissolving the photographic component may be any suitable solvent that may be utilized in the system in which precipitation takes place by solvent shift and/or acid shift. Typical of such materials are the solvents acetone, methyl alcohol, ethyl alcohol isopropyl alcohol, tetrahydrofuran, dimethylformamide, dioxane, N-methyl-2-pyrrolidone, acetonitrile, ethylene glycol, ethylene glycol monobutyl ether, diacetone alcohol, etc. A preferred solvent is n-propanol because n-propanol allows the particles to stay dispersed longer after formation in a stable dispersion.

The acid and base may be any materials that will cause a pH shift and not significantly decompose the photographic components. The acid and base utilized in the invention are typically sodium hydroxide as the base and propionic acid or acetic acid as the acid, as these materials do not significantly degrade the photographic components and are low in cost.

The process of this invention leads to gelatin free, fine particle colloidal dispersions of photographic materials, such as compounds 1 through 16, that are stable from precipitation at least for six weeks at room temperature. This is a cost saving feature as conventional milled dispersions need to be stored under refrigerated conditions. In particular, the process of this invention leads to dispersion of compounds 1 and 3 that are stable from precipitation or substantial particle growth virtually indefinitely at room temperature conditions. Under refrigerated conditions dispersions prepared by the method of this invention photographically useful lives anywhere between 3 months to greater than 3 years.

EXAMPLES

The following examples are intended to be illustrative and not exhaustive of the invention. Parts and percentages are by weight unless otherwise specified.

EXAMPLE 1

This example utilizes a process and apparatus generally as schematically illustrated in FIG. 1. The coupler solution, surfactant solution, and acid solution are prepared as follows:

| | | |
|---|---|---|
| Coupler solution: | Coupler #1 | 3000 g |
| | 20% NaOH | 750 g |
| | n-propanol | 7500 g |
| | | 11250 g |
| | Flow rate: | 547 g/min |

Above ingredients were mixed together and heated to 55° C. to dissolve the coupler and then cooled to 30° C. before use.

| | | |
|---|---|---|
| Surfactant solution: | High purity water | 45000 g |
| | Aerosol AlO2 (33%) | 2250 g |
| | (American Cyanamid) | 47250 g |
| | Flow rate: | 3030 g/min |
| Acid solution: | Propionic acid | 375 g |
| | High purity water | 2125 g |
| | | 2500 g |
| | Flow rate: | Approximately 106 g/min (adjusted to control the pH of the dispersion between 5.9 to 6.1). |

The description of the apparatus set up for this example is as follows:

Temperature-controlled, open top vessels

Gear pumps with variable speed drives

The mixer is a high fluid shear centrifugal mixer operated with a typical residence time of about 2 sec.

A SWAGE-LOC "T" fitting where surfactant and coupler streams join

Residence time in pipe between T-fitting and mixer is $<<1$ sec.

In-line pH probe is used to monitor pH in the pipe exiting the mixer

Positive displacement pump for recirculation in batch ultrafiltration

Ultrafiltration membrane is OSMONIC 20K PS 3' by 4" spiral wound permeator

PROCESS DESCRIPTION

The three solutions are continuously mixed in the high-speed mixing device in which the ionized and dissolved coupler is reprotonated causing precipitation. The presence of the surfactant stabilizes the small particle size dispersion. The salt byproduct of the acid/base reaction is sodium propionate. Ultrafiltration is used for constant-volume washing with distilled water to remove the salt and the solvent (n-propanol) from the crude dispersion. The recirculation rate is approximately 20 gal/min. with 50 psi back pressure which gives a permeate rate of about 1 gal/min. The washed dispersion is also concentrated by ultrafiltration to the desired final coupler concentration of about 10–15 weight percent. The time to perform the ultrafiltration and produce the final coupler concentration is about 1 hour. Average particle size is about 16 nanometers as measured by photon Correlation Spectroscopy. The particles formed in this example were utilized in formation of an experimental Ektacolor Paper multilayer as a substitute for the same yellow coupler formed by the known milling process. The material of this example is utilized with 25% less silver in the yellow layer and found to give substantially the same dye density performance. This indicates the very high activity of the coupler formed by the process of this invention, as well as material cost savings possible with their use.

EXAMPLE 2

This example illustrates the formation of a dispersion of photographic components utilizing the process as schematically illustrated in FIG. 2 in which the components are directly furnished to the mixer. The coupler solution, surfactant solution, and acid solution are the same as utilized in Example 1.

The three solutions are pumped from the individual tanks to a mixer by means of three gear pumps. The flow rates of each stream are controlled by an electronic controller which automatically compares the actual flow rate with the desired flow rate and adjusts the pump speed to make the actual coincide with the desired and the pH of the reactor in the steady state to remain at the set value of about 6.0. The three solutions are continuously mixed in the centrifugal mixer which promotes mixing by causing high fluid shear within the small mixing vessel (as opposed to high mechanical shear). The surfactant solution is mixed with the coupler solution inside the mixer. At the outlet of the mixer, there is a pH probe which monitors the pH of the exiting crude dispersion. The pH is adjusted between 5.9 and 6.1 by the operator initially by adjusting the acid flow rate setpoint until the desired pH is achieved. The crude dispersion containing the sodium propionate by-product of the acid-base reaction is then washed using ultrafiltration to remove the salt as in Example 1. The washing is followed by a concentration step to achieve the specified final coupler concentration as in Example 1. Particle size was found to be about 16 nm. This product is treated as a substitute for the dispersion in the yellow layer as in Example 1 with substantially identical results.

EXAMPLE 3

This example utilizes a process and apparatus 90 of FIG. 3 for continuous production of coupler dispersions in the manner of the invention described earlier.

| | | |
|---|---|---|
| Coupler solution: | Coupler No. 1 | 1280 g |
| | 20% NaOH | 320 g |
| | n-propanol | 3840 g |
| | | 5440 g |

The above ingredients were mixed together in a vessel as shown in FIG. 3, heated to 60° C. to dissolve completely, then cooled to 25° C. and added to the coupler solution vessel 100 of FIG. 3. The bath 136 in FIG. 3 was kept at 25° C.

| | | |
|---|---|---|
| Surfactant solution: | Distilled water | 38400 g |
| | 33% AlO2 | 2816 g |
| | | 41216 g |

The above ingredients were mixed together in a separate vessel (not shown) in FIG. 3 and added to the surfactant vessel 92. The acid kettle 96 was filled with 15% propionic acid (2 kg). The density of the coupler solution 102 was determined to be 0.875 g/cc. The surfactant pump 108 was started at a flow rate of 912 ml/min with the stirrer 116 at 2000 RPM. Then the coupler pump 112 was turned on at a rate of 16 ml/min. The pH controller 120 was set at 5.8 which controlled the pH by turning on the acid pump 118 at a pH above 5.8 and pump 118 off as the pH went below 5.8. In effect, pH was controlled at 5.8 ±0.2. Precipitation was carried out at 25° C. The dispersion outflow rate was maintained at 141 ml/min by pump 132 at a head such that the reactor always contained 600 ml of dispersion. Precipitation was carried out until 55 liters of the coupler dispersion was collected. The formed dispersion was washed for five turnovers by ultrafiltration at constant volume with distilled water to remove the n-proponol and sodium propionate as in Example 1. The dispersion was then concentrated to 10.8% of the coupler by weight. Particle diameter of the final dispersion was 20 mm. The diafiltration system is not shown in FIG. 3 but is similar to that shown in FIGS. 1 and 2.

The description of apparatus set up for this example is as follows:

| | |
|---|---|
| pH-controller 12 | Manufactured by SIGNET |
| All pumps 108, 118, 112, and 132 | Materflex Peristaltic Pumps |
| Electrode system | Corning combination pH electrodes |
| Stirrer | air driven stirrer with Cole Parmer Digital Tachometer for determination of speed of rotation. |

The formed product was treated as a substitute for the dispersion in the yellow layer as in Example 1 with substantially identical results.

EXAMPLE 4

The process utilizes the semicontinuous pH-controlled coupler precipitation apparatus described in FIG. 4. This apparatus produced about 800 ml of dispersion.

| | | |
|---|---|---|
| Coupler solution: | Coupler No. 1 | 20 g |
| | 20% NaOH | 5 g |
| | n-propanol | 40 g |
| | | 65 g |

Above ingredients mixed together and heated t 60° C. with stirring to dissolve the coupler and then cooled to room temperature in a separate vessel (not shown) in FIG. 4 and added to the coupler kettle 100.

| | | |
|---|---|---|
| Surfactant solution: | Distilled water | 500 g |
| | Aerosol AlO2 (33% solution) | 15 g |
| | | 515 g |

Above ingredient added in the reaction kettle 104 of FIG. 4 and stirred to mix. The acid kettle filled with 15% propionic acid. Stirrer 116 was maintained at 2000 rpm. The basic coupler solution was pumped into the reaction kettle at 20 mg/min. The pH-controller was set at 6.0, which controlled the pH by turning the acid pump on as the pH went over 6.0, and off as the pH fell below 6.0. In effect, pH was controlled to 6.0±2 as determined the strip chart recorder 130. Precipitation was carried out at room temperature. After precipitation the resultant dispersion was washed by dialysis against distilled water for 24 hours. The dispersion gave a particle diameter of 14 nm by photon correlation spectroscopy. The final product was coated in single yellow layer coatings of format similar to that of Example 1, and results were substantially the same.

The description and examples above are intended to be exemplary and not exhaustive of the possibilities of the invention. While described with a specific coupler, it is possible to utilize other coupler and hydrophobic components of photographic systems. The process also will find use in forming dispersion of materials for other uses such as paint or electrophotographic compositions. Further, while illustrated with specific types of mixers and holding tanks, other material handling means also could be utilized in handling of the solution and dispersions of the invention. The invention is only intended to be limited by the claims attached hereto.

What is claimed is:

1. A method of preparing aqueous dispersions of a photographic material comprising continuously providing a first solution comprising water and a surfactant, continuously providing a second solution comprising a solvent, base, and photographic material, continuously mixing said first and said second solutions, and immediately neutralizing with an acid solution the mixed solutions to precipitate particles of said photographic material as a fine particle colloidal dispersion of said photographic material.

2. The method of claim 1 wherein immediately after mixing, the mixture of the first stream, and second stream is adjusted to a pH of about 6.0 to form stable particles.

3. The method of claim 2 wherein said neutralizing is to pH of about 6 and performed by the addition of organic acids.

4. The method of claim 1 wherein said photographic material comprises at least one of the following:

(1)

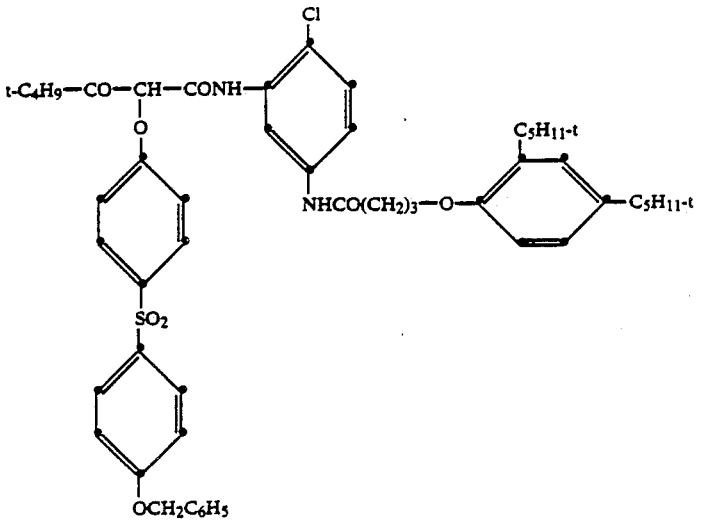

(2)

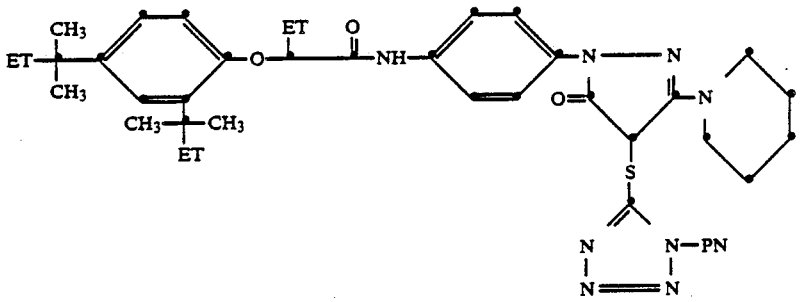

(3)

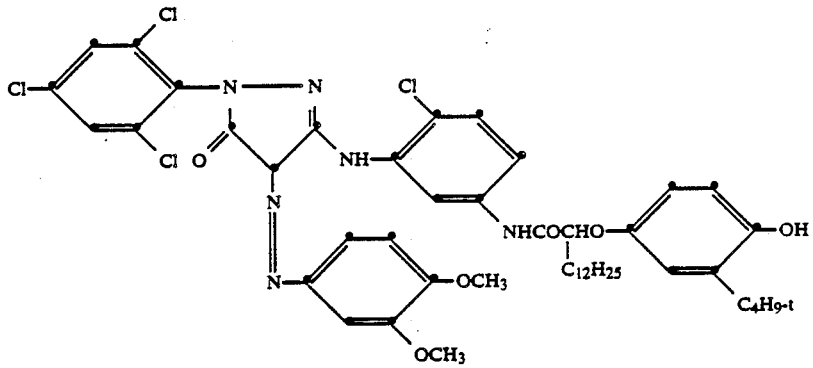

(4)

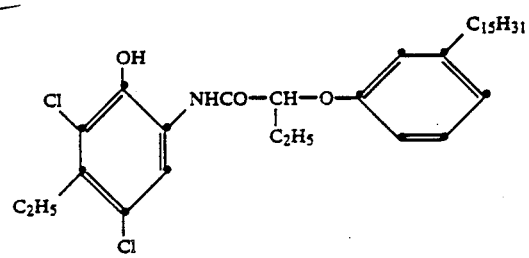

-continued
(5)
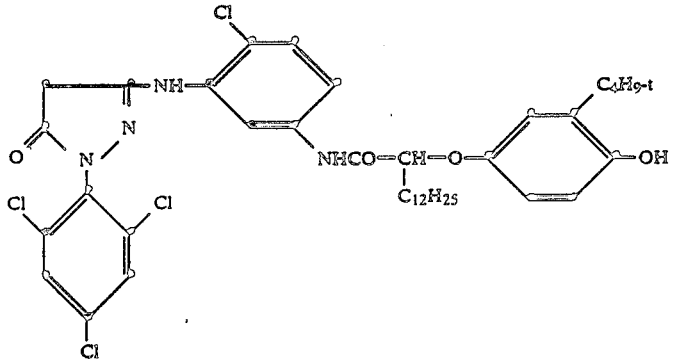
(6)
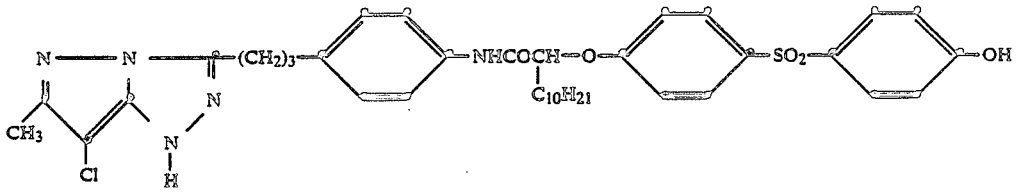
(7)
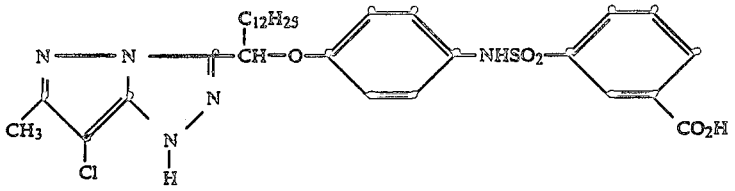
(8)
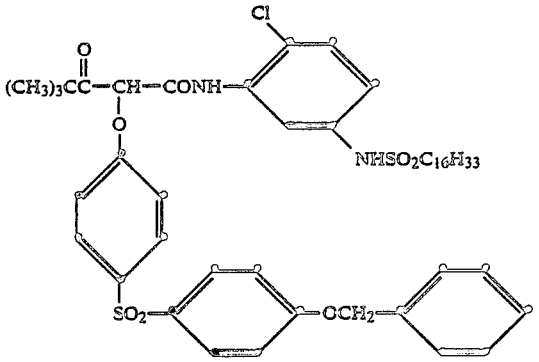
(9)
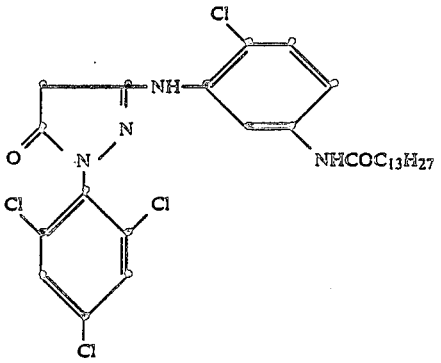
(10)
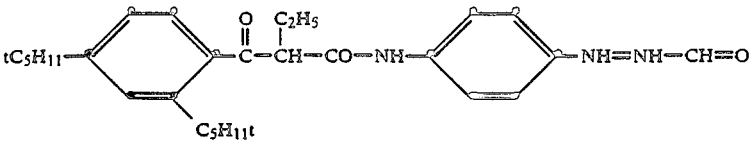

-continued (11)

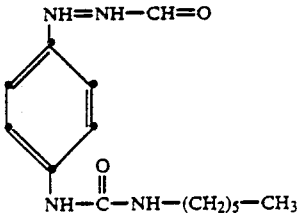

(12)

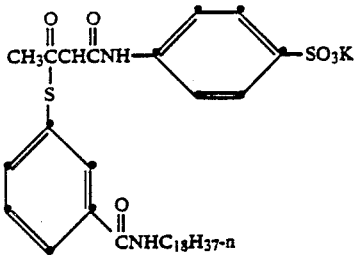

(13)

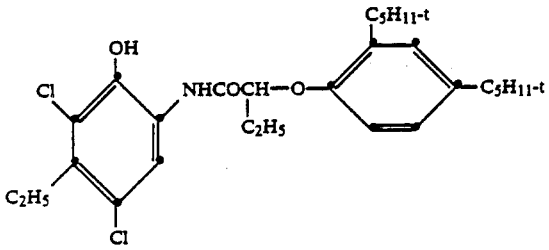

(14)

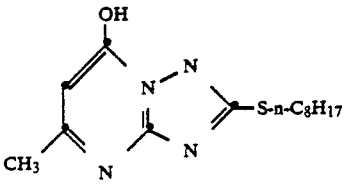

(15)

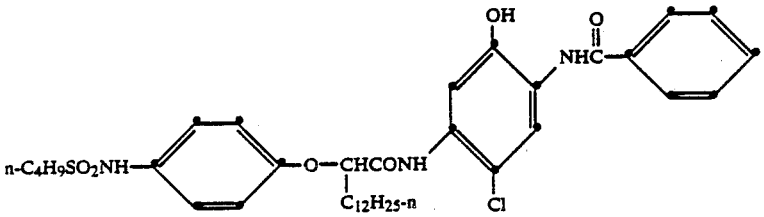

(16)

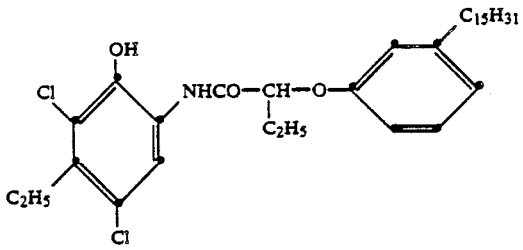

5. The method of claim 1 wherein said mixing of said first solution and said second solution, and said neutralizing takes place simultaneously.

6. The method of claim 1 wherein said base comprises sodium hydroxide.

7. The method of claim 1 wherein the particles in said colloidal dispersion are of a size between about 5 and about 300 nm.

8. The method of claim 4 wherein after said neutralizing the said colloidal dispersion is immediately processed to remove said solvent and salt by products of neutralizing to prepare the particles for use in forming a photographic element.

9. The method of claim 2 wherein during said neutralizing the pH is adjusted to about 6 at a location downstream from the initial mixing of said first and said second solutions.

10. The method of claim 1 wherein said mixing is for about 2 seconds.

11. The method of claim 2 wherein said neutralizing to a pH of about 6 utilizes acetic acid.

12. The method of claim 2 wherein said neutralizing to a pH of about 6 utilizes propionic acid.

13. The method of claim 1 wherein said mixing and said neutralizing is complete in between about 1 and about 10 seconds.

14. The method of claim 1 wherein said immediately neutralizing is with low mechanical shear and high fluid shear.

15. The method of claim 1 wherein said immediately neutralizing takes place in less than about two minutes after said mixing.

16. The method of claim 1 wherein said immediate neutralizing is complete in less than about five seconds after said mixing.

17. The method of claim 1 wherein the method is operated in a semicontinuous manner.

18. The method of claim 8 wherein the method is performed continuously.

19. The method of claim 1 wherein said photographic material comprises at least one member selected from the group comprising couplers, UV absorbers, reducing agents, and developing agents.

20. The method of claim 1 wherein said photographic material comprises photographic couplers.

21. The method of claim 1 wherein said surfactant is base degradable.

22. The method of claim 1 wherein said surfactant is hydrolyzable.

23. The method of claim 1 wherein said first solution, said second solution, and a neutralizing acid solution are simultaneously mixed to precipitate and immediately neutralize said photographic material in a fine particle colloidal dispersion at about pH 6.0.

24. The method of claim 8 wherein said dispersion is stable from precipitation at room temperature storage for at least six weeks.

25. The method of claim 8 wherein dispersion of compounds 1 and 3 are stable from precipitation under room temperature storage for at least 1 year.

26. The method of claim 1 wherein said first solution and said second solution are mixed and then the mixture of said first and said second solutions is neutralized by addition of an acid.

27. The method of claim 1 wherein said surfactant is selected from the group consisting of

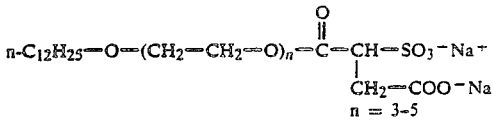

n = 3-5

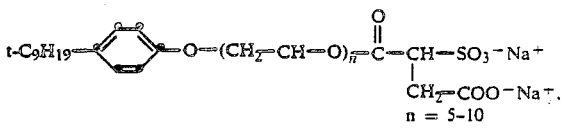

n = 5-10 mixtures thereof.

28. The method of claim 1 wherein said surfactant comprises

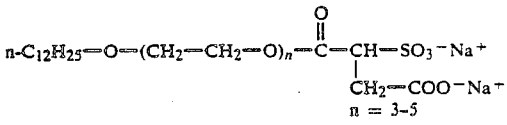

n = 3-5

29. The method of claim 1 wherein said surfactant comprises

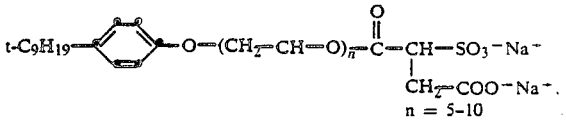

n = 5-10

* * * * *

UNITED STATES PATENT AND TRADEMARK OFFICE

CERTIFICATE OF CORRECTION

PATENT NO. : 4,990,431

DATED : February 5, 1991

INVENTOR(S) : Bagchi et al

It is certified that error appears in the above-identified patent and that said Letters Patent is hereby corrected as shown below:

In Column 24, line 22, insert - - and - - before "mixtures."

Signed and Sealed this

Twenty-third Day of June, 1992

*Attest:*

DOUGLAS B. COMER

*Attesting Officer*

*Acting Commissioner of Patents and Trademarks*